United States Patent [19]

Masacchia

[11] 4,414,777

[45] Nov. 15, 1983

[54] BREAK AWAY WALL STRUCTURE

[76] Inventor: John Masacchia, P.O. Box 452, Marathon, Fla. 33050

[21] Appl. No.: 205,882

[22] Filed: Nov. 10, 1980

[51] Int. Cl.[3] ..... E05B 65/10; E05C 15/02

[52] U.S. Cl. ..... 49/141; 49/395

[58] Field of Search ..... 49/141, 395, 366, 369

[56] References Cited

U.S. PATENT DOCUMENTS

| | | | |
|---|---|---|---|
| 2,869,486 | 1/1959 | Scites | 49/141 X |
| 3,462,182 | 8/1969 | Schacht | 49/366 X |
| 3,724,130 | 4/1973 | Bogue | 49/141 |
| 3,940,886 | 3/1976 | Ellingson, Jr. | 49/141 X |
| 4,164,095 | 8/1979 | Musacchia | 49/141 X |
| 4,283,882 | 8/1981 | Hubbard et al. | 49/141 |

*Primary Examiner*—Philip C. Kannan

*Attorney, Agent, or Firm*—John Maier, III

[57] ABSTRACT

A break away wall structure including a door panel aligned edge to edge with a wall panel. The wall panel is locked in place by spring-loaded plungers which can be actuated by a handle kept from normal use. In the event of panic, due to a fire or an explosion, the force of the explosion or the pressure of people against the wall panel will force the wall panel open causing the door panel to open with the wall panel.

2 Claims, 4 Drawing Figures

BREAK AWAY WALL STRUCTURE

BACKGROUND OF THE INVENTION

1. Field of the Invention

The present invention relates to a break away wall structure. More particularly, the present invention is directed to a wall structure for use in public places where crowds can be trapped in the event of fire or other disaster. Also, in the event of explosion, the break away wall structure will open automatically to release the pressure preventing the building from collapsing.

2. Description of the Prior Art

Various structures have been used for permitting crowds quickly to exit from a building in the event of fire or other emergency. Some of these have offered substantial advantages and undoubtedly have been helpful in saving human life. However, it is important that such a structure be not only operative and functional but inexpensive and easy to install. Of particular importance is that the structure must be fail safe.

Accordingly, it is a function of this invention to provide a break away wall structure which can be readily installed and which will assure escape in the event of panic while also providing security from regular ingress or egress to the building.

The novel features which are considered as characteristic of the invention are set forth with particularity in the appended claims. The invention itself, however, as to its construction and obvious advantages will be best understood from the following description of the specific embodiment when read with the accompanying drawings.

SUMMARY OF THE INVENTION

The present invention overcomes the disadvantages of the prior art and in so doing provides a simple, durable and inexpensively installed, break away wall structure for use in a building where a comparatively large number of people could need to exit quickly.

Two distinct panels are provided within a frame. One of the panels is a door panel mounted on hinges with a lock which can be opened either from the inside or outside or both. The other panel, which is a wall panel, appears to be part of the wall of the building in which it is located but remains available for emergency use at all times. The edges of the two panels directly contact one another. The wall panel is mounted on hinges which are pins, the pointed ends of which go into the frame in which the two panels are mounted. At the edge of the wall panel adjacent the door panel a pair of vertically-oriented plungers are located, one plunger being situated at the top of the wall panel and the other plunger being located at the bottom of the wall panel. Both are spring-loaded and both are rounded so as only to sit into semi-spherical recesses in the door frame. A lever mechanism is provided to pull back the spring-loaded plungers by means of a handle located behind a glass panel which can be broken in an emergency but will prevent ready use of the wall panel for normal ingress and egress. Whatever lock is used to secure the door panel, it includes a tongue which extends into the wall panel, the opening of the wall panel causes both panels to open wide. By pulling the handle, the plungers are withdrawn and both panels will open even if the door panel is locked.

DESCRIPTION OF THE DRAWINGS

The present invention may be better understood and its numerous advantages will become apparent to those skilled in the art by reference to the accompanying drawings wherein like reference numerals refer to like elements in the various figures in which.

DETAILED DESCRIPTION OF THE INVENTION

Figure 1:
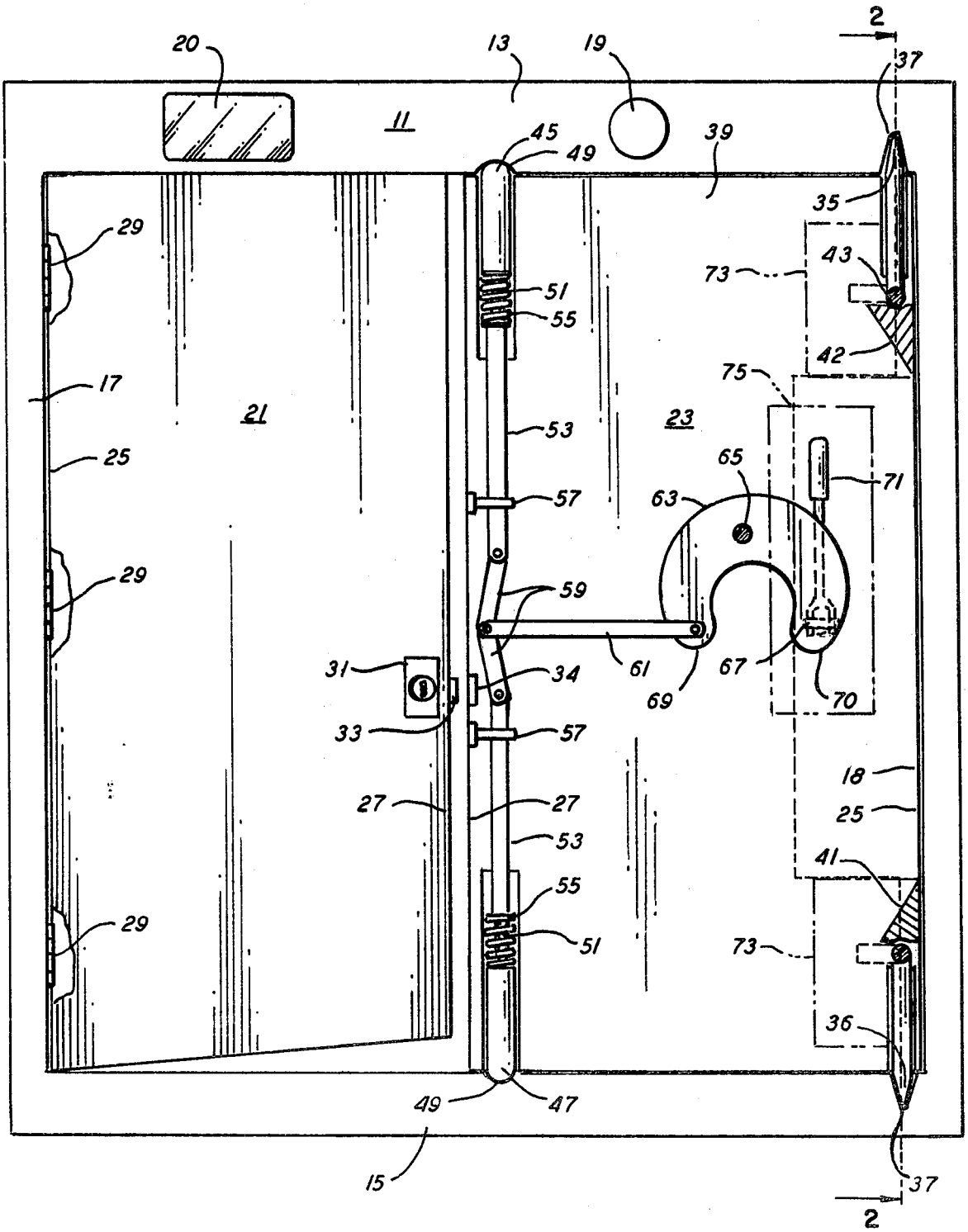
FIG. 1 is a front elevation of the structure with the inside sheet removed to show the mechanism by which the door panel is actuated.
Figure 4:
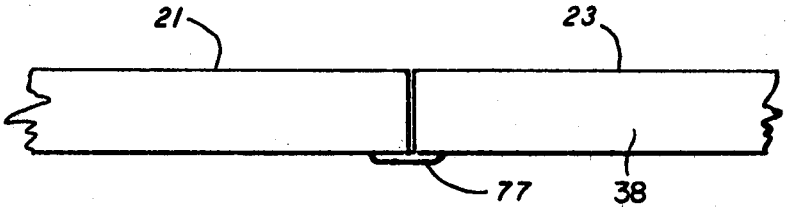
FIG. 4 is a top view of the door panel and wall panel partially broken away.
Figure 3:
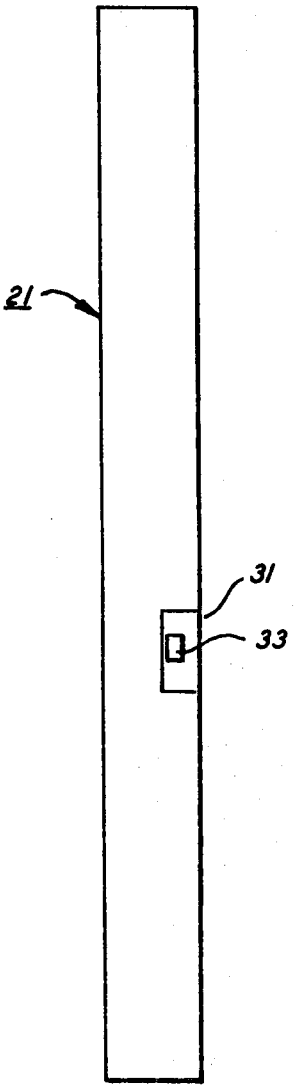
FIG. 3 is a side view of the door panel.
Figure 2:
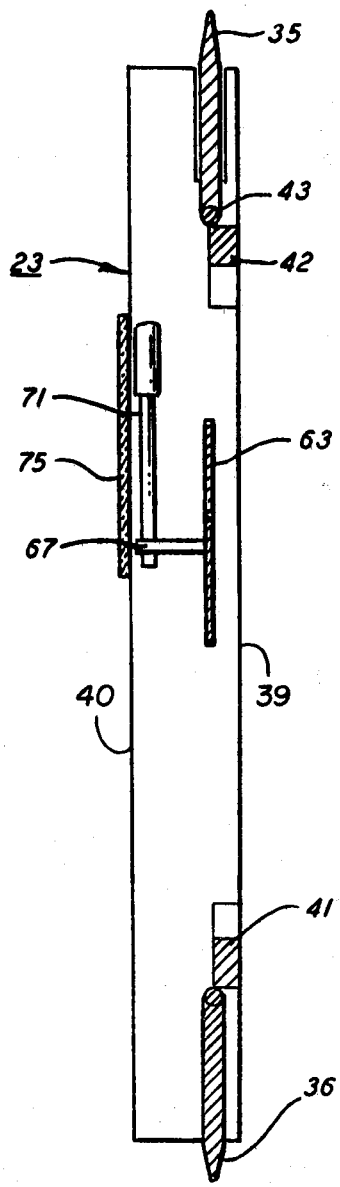
FIG. 2 is a cross-sectional view of the door panel along line 2—2 of FIG. 1.

The break away wall structure in accordance with this invention includes a frame 11 located within the wall of a building, most usually a public building where crowd safety is required. A frame 11 includes a top section 13, a bottom section 15, a left section 17 and a right section 18. An alarm 19 and a exit light 20 are located in the top section 13. The break away wall structure has two panels, namely a door panel 21 and a wall panel 23. The two panels 21, 23 function together within the frame 11 to form the break away wall structure. As best seen in FIG. 1, the door panel 21 is mounted along the left section 17 of the frame 11 and the wall panel 23 is located along the right section 18 of the wall structure. However, a reverse orientation would also be within the scope of the invention. Similarly, the two panels 21, 23 are shown to be of substantially the same size. In all likehood, the wall panel 23 would exceed the size of the door panel 21. Each of the panels 21, 23 has an outside edge 25 adjacent the frame 11 and an inside edge 27. The two inside edges 27 directly face or oppose one another. The door panel 21 is connected to the left section 17 of the frame 11 by means of standard hinges 29. The door panel 21 also includes a lock 31 which has a retractable tongue 33 which can be retracted by any suitable means (not shown) to open just the door panel 21 in the usual manner in which a door is utilized. It should be noted that there is no center partition in the frame 11 to receive the tongue 33 of the door panel 21 but rather such tongue 33 fits directly into an opening 34 in the wall panel 23.

The wall panel 23 is mounted specially in the frame 11. Pins 35, 36 which are vertically oriented extend from the wall panel 23 into openings 37 which are vertically oriented in the top and bottom section 13, 15 of the door frame 11 adjacent the right section 18 of the frame 11. The wall panel 23 is hollow, being formed from edge members 38 and an outside sheet 39 and an inside sheet 40. A lower triangular bracket 41 is located above the lower door pin 36 and an upper triangular bracket 42 is located directly under the upper door pin 35. Each of the pins 35, 36 has a foot 43 extending at a right angle to the pin 35, 36 itself which presses against its respective bracket 41, 42. In this way, each pin 35, 36 is held in a fixed position.

Along the inner edge 27 of the wall panel 23, there is a pair of opposing plungers 45, 47, namely an upper plunger 45 and a lower plunger 47, both of which are vertically oriented. The upper plunger 45 extends into the top section 13 of the frame 11 and the lower plunger 47 extends into the lower section 15 of the frame 11.

Each of the two plungers 45, 47 has a rounded semi-spherical end which fits into a semi-spherical notch 49 in the frame 11. Each plunger 45, 47 is slidably mounted on the end of a rod 51. Each rod 51 is secured to the end of an arm 53. A coil spring 55 is located between each plunger 45, 47 and its respective arm 53 to force each of the plungers 45, 47 into the frame 11. The pair of arms 53, like the rods 51 and the plungers 45, 47 extend in opposing vertical directions. Each arm 53 is slidably mounted in a bracket 57 affixed inside the wall panel 23.

A pair of pivotably mounted actuating levers 59 are pivotably mounted on each end of the arms 53 remote from the plungers 45, 47. The pair of levers 59 are connected to one another at the end remote from the arms 53. A horizontal bar 61 is connected pivotably to the two levers 59 at the point where the two levers 59 are connected to each other. The combined length of the two levers is just sufficient to force the plungers 45, 47 to their outermost extreme position.

The opposite end of the bar 61 is pivotably mounted to a crescent-shaped lever plate 63 which is also pivotably mounted within the wall panel 23 by a bolt or pin 65. A lug 67 extends horizontally outwardly from the crescent-shaped lever plate 63. The crescent-shaped lever plate 63, which also resembles an inverted-U forms two lower tips 69, 70. One tip 69, located closest to the levers 59, is connected to the end of the bar 61. The lug 67 is rigidly mounted on the opposite tip 70. A vertical handle 71 is rigidly mounted on the end of the lug 67. Thus the handle 71 is rigidly connected to the crescent-shaped lever plate 63. By rotation of the crescent-shaped lever plate 63 by movement of the handle 71 toward the levers 59, the crescent-shaped lever plate 63 will rotate about the pin 65 thereby pulling the bar 61 toward the handle 71. When the bar 61 is pulled toward the handle 71, the levers 59 will also move toward the handle 71 and the arms 53 as well as the rods 51 secured to the arms 53 will thereby pull the plungers 45, 47 back from the frame 11 thus permitting the wall panel 23 to be opened. However, should sufficient pressure due to an explosion or due to a crowd pressing against the wall panel 23 create a substantial force on the wall panel 23, the semi-cylindrical plungers 45, 47 will be forced out of their respective semi-spherical notches 49 overcoming the resistance of the springs 55.

Panels 73 are mounted over the hinge pins 35, 36 for setting of the pins 35, 36. A glass panel 75 is also mounted over the handle 71 which glass panel 75 can be broken in an emergency to reach the handle 71 in a crisis situation to open the wall panel 23.

If the door panel 21 is locked when an emergency arises, the wall panel 23 can be actuated by breaking the glass 75 and pulling the handle 71 or by pressure against the wall 23 itself. Once the wall panel 23 swings open, there is nothing to keep the door panel 21 closed since the tongue 33 of the lock 31 on the door panel 21 will slide out of the opening 34 in the wall panel 23 when it is opened thereby permitting both pamels 21, 23 to open. When both panels 21, 23 are closed, a weather strip 77 which is secured to the wall panel 23 presses against the door panel 21 to avoid loss of energy between the panels 21, 23.

While a preferred embodiment has been shown and described, various modifications and substitutions may be made without departing from the spirit and scope of this invention. Accordngly, it is understood that this invention has been described by way of illustration rather than limitation.

I claim:

1. A break away wall structure comprising:

a frame;

a door panel pivotably mounted along one edge within said frame;

a wall panel, said wall panel and said door panel each having one edge abutting each other, said wall panel being pivotably mounted along one edge within said frame;

a locking means including a tongue slidably mounted on the door panel and extending into the wall panel;

a pair of opposed vertically-oriented plungers slidably mounted in said wall panel along the edge abutting the door panel and extending into said door frame, each of said plungers having a semi-spherical shape;

a pair of opposed vertically-oriented rods slidably mounted in said wall panel aligned with said pair of opposed vertically-oriented plungers, said pair of opposed vertically-oriented plungers being slidably mounted on said rods;

a pair of vertically-oriented arms, each of said vertically-oriented arms being secured at one end to the end of a different one of said rods;

spring means mounted on said rods between said opposed vertically-oriented plungers and said arms to force said opposed vertically-oriented plungers into said door frame;

a pair of actuating levers, each pivotally connected at one end to the end of a different one of said arms remote from said rods and the other end of said actuating levers being pivotably connected to one another; and means including a handle pivotably mounted within said wall panel and pivotably connected to said pair of actuating levers where said actuating levers are connected to one another to pull said actuating levers toward said handle thereby pulling said vertically-oriented arms and vertically-oriented rods toward said levers and releasing said opposed vertically-oriented plungers from said door frame.

2. A break away wall structure comprising:

a frame;

a door panel pivotably mounted on one edge within said frame;

a wall panel, said wall panel and said door panel each having one edge abutting each other, said wall panel being pivotably mounted on a pair of pointed pins within said frame;

a locking means including a tongue slidably mounted on the door panel and extending into the wall panel;

a pair of opposed vertically-oriented plungers slidably mounted in said wall panel and extending into said door frame, each of said plungers having a semi-spherical shape;

a pair of vertically-oriented rods within said wall panel, said pair of opposed vertically-oriented plungers being slidably mounted on said rods;

a pair of vertically-oriented arms within said wall panel, each of said vertically-oriented arms being secured at one end to the end of a different one of said rods;

spring means mounted on said rods between said opposed vertically-oriented plungers and said arms to force said opposed vertically-oriented plungers into said door frame;

a pair of actuating levers within said wall panel, each pivotably connected at one end to the end of a different one of said arms remote from said rods and at the other end of said levers being pivotably connected to one another;

a horizontal bar within said wall panel having two ends, one end being pivotably connected to the ends of said levers where said levers are pivotably connected to one another;

a crescent-shaped plate pivotably mounted within said wall panel in the form of an inverted-U with two tips extending downwardly, one of said tips being closer to said levers and the other tip being more remote from said levers, said horizontal bar being pivotably connected at its other end to said crescent-shaped plate at the tip closer to the said levers; and a handle means rigidly connected to said crescent-shaped plate at said tip remote from said levers, said handle being adapted to pivot said crescent-shaped plate and to pull said horizontal bar toward said handle thereby pulling said vertically-oriented arms and said vertically-oriented rods toward said levers and releasing said opposed vertically-oriented plungers from said door frame.

* * * * *